US005101514A

United States Patent [19]

Eklund

[11] Patent Number: 5,101,514

[45] Date of Patent: Apr. 7, 1992

[54] ARTICLE OF CLOTHING

[75] Inventor: Jan Eklund, Hofors, Sweden

[73] Assignee: E.S.E.Flectalon HB, Hofors, Sweden

[21] Appl. No.: 452,551

[22] Filed: Dec. 19, 1989

[30] Foreign Application Priority Data

Jan. 4, 1989 [SE] Sweden ..... 8900020

[51] Int. Cl.[5] ..... A41D 3/02

[52] U.S. Cl. ..... 2/94; 2/87

[58] Field of Search ..... 2/2, 46, 47, 69, 70, 2/85, 86, 87, 93, 94

[56] References Cited

U.S. PATENT DOCUMENTS

| | | | |
|---|---|---|---|
| 1,626,166 | 4/1927 | Stair | 2/94 |
| 2,661,474 | 12/1953 | Tate | 2/94 |
| 2,736,030 | 2/1956 | Moody | 2/94 |
| 3,185,362 | 5/1965 | Wakefield | 2/46 |
| 4,689,829 | 9/1987 | Kaplan | 2/69 |
| 4,712,252 | 12/1987 | Chou | 2/87 |
| 4,817,210 | 4/1989 | Aldridge | 2/87 |

FOREIGN PATENT DOCUMENTS

| | | | |
|---|---|---|---|
| 2463588 | 2/1981 | France | 2/94 |
| 652828 | 5/1951 | United Kingdom | 2/94 |
| 2157544 | 10/1985 | United Kingdom | 2/86 |

*Primary Examiner*—Werner H. Schroeder
*Assistant Examiner*—Diana L. Biefeld
*Attorney, Agent, or Firm*—Kane, Dalsimer, Sullivan, Kurucz, Levy, Eisele and Richard

[57] ABSTRACT

The present invention relates to an outer garment intended to cover at least the upper part of the body of a person and comprising a preferably heat and/or moisture insulating protective-part or seat-pad (2) which can be moved relative to the remainder of the garment (1) between a first position in which the protective-part is located inwardly of the back-part of the garment and a second position in which the protective-part can be brought beneath the buttocks of the garment wearer, so as to function as a seat pad. At least the back-part of the garment comprises at least two mutually overlapping layers of material (3, 4), such as a lining and an outer fabric. Provided in the bottom of the back-part of the garment is an opening (7) which leads to a space (5) provided between the layers materials. The space (5) is intended to accommodate essentially the whole of the protective-part (2) in its first position. The protective-part is suspended on at least one elongated, flexible member (9, 13) which is fastened at one end to the protective-part in the region of one defining edge-margin (8) thereof and in the second position of the protective-part is passed in through the opening (7) and into the space (5) and can be fastened to the upper part of the garment such as to hang the protective-part (2) in this upper garment part. The elongated member functions to enable the protective-part to be moved through the opening (7) between the first and the second positions, by extending and shortening the distance between the attachment points of the elongated member (3, 13) on the protective-part (2) and the point of attachment of this protective-part in the upper part of the garment (1).

8 Claims, 2 Drawing Sheets

ARTICLE OF CLOTHING

TECHNICAL FIELD

The present invention relates to an external, personal garment intended for covering at least the upper part of the body and comprising a preferably heat and/or moisture insulating protective-part which can be moved relative to the remainder of the garment between a first position in which said part is concealed behind the back part of the garment, and a second position in which said protective-part can be brought beneath the buttocks of the person wearing the garment, so as to function as a seat, and the back part of which garment has provided in the lower region thereof with an opening through which access can be had to a space located within the garment above said opening. The space is intended to accommodate substantially the whole of the protective-part in its first position. Two elongated, flexible members are attached at their one end to the upper edge margin of the protective-part, said upper edge-margin depending from said flexible members, and which elongated members, in the second position of the protective-part, can be inserted through the opening and into said space and secured to parts of the garment which are located outside the upper edge-margin of the protective-part, when said protective-part is in its first position, that the protective-part hangs from said garment-parts, and in which the elongated members enable the protective garment-part to be inserted through the opening when moved between the first and second position, by shortening and lengthening respectively the distance between the points at which the elongated members are attached to the protective-part and their points of attachment to said parts of the garment.

The garment concerned may be any form of outer garment intended to cover at least the upper part of a person's body, such as a jacket, a waistcoat, vest, or alternatively an outer coat, a complete set of overalls (for instance a ski suit) and the like. In the following description, the invention is described with reference to a sports jacket, although it will be understood that the invention is not restricted to particularly this type of outer garment.

It will be agreed that in certain situations, particularly cold-weather situations, it can be desirable to have about one's person something which can be used comfortably as a seat. Such instances can occur when skiing, for instance when travelling in a ski lift, when fishing on frozen water through holes in the ice (jigging), and when on mountain walks. It will also be agreed that the additional encumberance of a "loose seat" on such occasions is undesirable. This problem is solved by means of the present invention, which provides a garment which incorporates a part that can be used effectively as a seat pad.

BACKGROUND PRIOR ART

French Patent Specification No. 2 463 588 describes and illustrates an outer garment, namely a sports jacket, of the kind described in the introduction. This known jacket has a protective-part which is attached at one end to the lower end of the back-part of the jacket. The protective-part can be moved between a first position, in which it lies against the inner surface of the back-part of the jacket, and a second position in which it extends from said back-part and in beneath the buttocks of the wearer. The protective-part is secured in the crotch of the wearer by means of buttons, for instance, provided on the lower part of the front of the jacket. The protective-part of the known jacket is secured at one end at one and the same position on the inside of the jacket, in the lower region of the back-part of the jacket, in both positions of said protective-part.

The jacket described and illustrated in the aforesaid French publication is encumbered with significant drawbacks with respect to the ability of the protective part to fulfill the function for which it is intended. Furthermore, the work required to bring the protective-part from one position to the other can be quite strenuous. For instance, because one end of the protective-part is fixedly attached to the garment, the surface of the protective-part which is intended to face towards the ground or corresponding foundation surface subsequent to bringing said protective-part to its appropriate position from within the jacket, will face inwardly towards the back of the wearer. This is most undesirable, since the wearer must first seat himself on a cold or wet surface and then attempt to return the protective-part to its position within the jacket, in which position the cold and/or wet surface will be faced inwardly towards the back of the wearer, causing discomfort and possible injury to the wearer. As a result, once having brought the protective-part to a position in which it can be sat upon, the wearer is most likely to decide to allow the protective-part to remain hanging from the garment until he is indoors and can heat or dry the protective-part of said garment, despite the fact that said protective-part may obstruct the movements of the wearer whilst he is outdoors. Another serious drawback with the known jacket is that it is extremely difficult, if not at times impossible, for the protective-part of the jacket to be moved between the various positions without first removing the jacket. Naturally, the necessity of having to remove the jacket can be most undesirable, especially when ambient temperatures are very low and weather conditions are harsh. It should be borne in mind that the jacket and its protective-part are particularly designed for use in such weather conditions. Naturally, the protective-part of this jacket can be moved between its various positions by a friend or some other person, when available, and thus obviate the need to remove the garment. It is doubtful, however, that movement of the protective-part attached to the jacket can be effected readily between said positions with the jacket in place, and it is highly probable that the protective-part of the known jacket is intended to be kept in one or the other of its positions, depending upon the prevailing circumstances.

U.S. Pat. No. 2,661,474 teaches an outer garment which includes a seat pad which is held by two elongated, elastic members which are secured at one end thereof to the inside of the garment and at the other end thereof to the upper edge margin of the seat pad. When wishing to use the seat pad, the wearer is required to place his hands behind his back and inside the garment, so as to be able draw the seat pad down to an effective position.

SUMMARY OF THE INVENTION

The object of the present invention is to provide an outer garment of the kind defined in the preamble of the following claim 1 and known from U.S. Pat. No. 2,661,474, and which will afford to the wearer optimal comfort when the protective-part is located in its the first position and which will not detract from the aesthetic appearance of the garment when worn, and with which it is possible to move the protective-part between the aforesaid first and second positions in a ready and simple fashion and enable the protective-part to be readily adjusted in the second position, without stretching or pulling any part of the garment as a result thereof.

This object is achieved with a garment constructed in accordance with the invention and having the characteristic features set forth in the characterizing clause of claim 1. Thus, the inventive garment is characterized in that at least the back-part of said garment has at least two mutually overlapping material layers, for instance a lining layer and an outer fabric layer; in that said space is located between said layers; in that the elongated members extend out from said space and through openings in the collar region of the garment; and in that the elongated members have a length extension which enables said distance to be lengthened and shortened by varying the length of those parts of the elongated members which extend out of the openings in said collar region, therewith enabling said members to extend further through said openings or to be drawn to a great extent out through said openings.

Thus, in the case of the inventive garment, the protective-part can be moved between its first and its second position and also adjusted in said second position, by simply pulling-in or slackening the parts of the elongated, flexible members extending through the openings provided in said collar region, such that the protective-part will be located appropriately without creating in the garment stresses which are liable to deform or misshapen the garment. One significant advantage afforded by this feature of the invention lies in the fact that the collar region of the garment can be reached readily by the person wearing the garment. In the case of the known garments, however, it is necessary for the person wearing the garment to place his or her hands behind their back and attempt to manoeuvre the elongated members so that the protective-part can be brought to its effective position, which can be a relatively complicated procedure. Alternatively, the person wearing the known garment is necessitated to remove the garment before being able to manoeuvre the elongated members and bring the protective-part of the garment to the position desired. A further advantage afforded by the present invention is that the protective-part attached to the garment is accommodated fully in a space provided between two mutually overlapping layers of material on the outer garment. Consequently, the wearer will hardly be aware of the presence of the protective-part when said part occupies its first position in the garment, and the garment can thus be worn with the utmost of comfort.

Furthermore, the protective-part is separated by said material layers from the wearer's clothes beneath the outer garment, which is advantageous when the protective-part is soiled or wet as a result of having been sat upon. The expression "two mutually overlapping material layers" also includes different designs of pocket sewn onto the inside or outside of the back-part of the garment, wherewith a downwardly open pocket on the outside of said back-part will enable the inventive concept to be applied to overalls or like garments comprising combined upper and lower garments, e.g. trouser and jacket.

Another advantage afforded by the present invention resides in the fact that the protective-part by virtue of the arrangement of the elongated, flexible member on the garment, can be moved away from the remainder of the garment and positioned relatively to the garment in said second position to suit the requirements of any situation and the wishes of the wearer, i.e. can be moved in selected direction relative to the buttocks of the wearer.

Other advantages and beneficial features of the present invention will be apparent from the following description and the depending claims.

BRIEF DESCRIPTION OF THE DRAWINGS

So that the invention will be more readily understood and further features thereof become apparent, an exemplifying embodiment of the present invention will now be described in more detail with reference to the accompanying drawings, in which.

DESCRIPTION OF A PREFERRED EMBODIMENT

Figure 1:
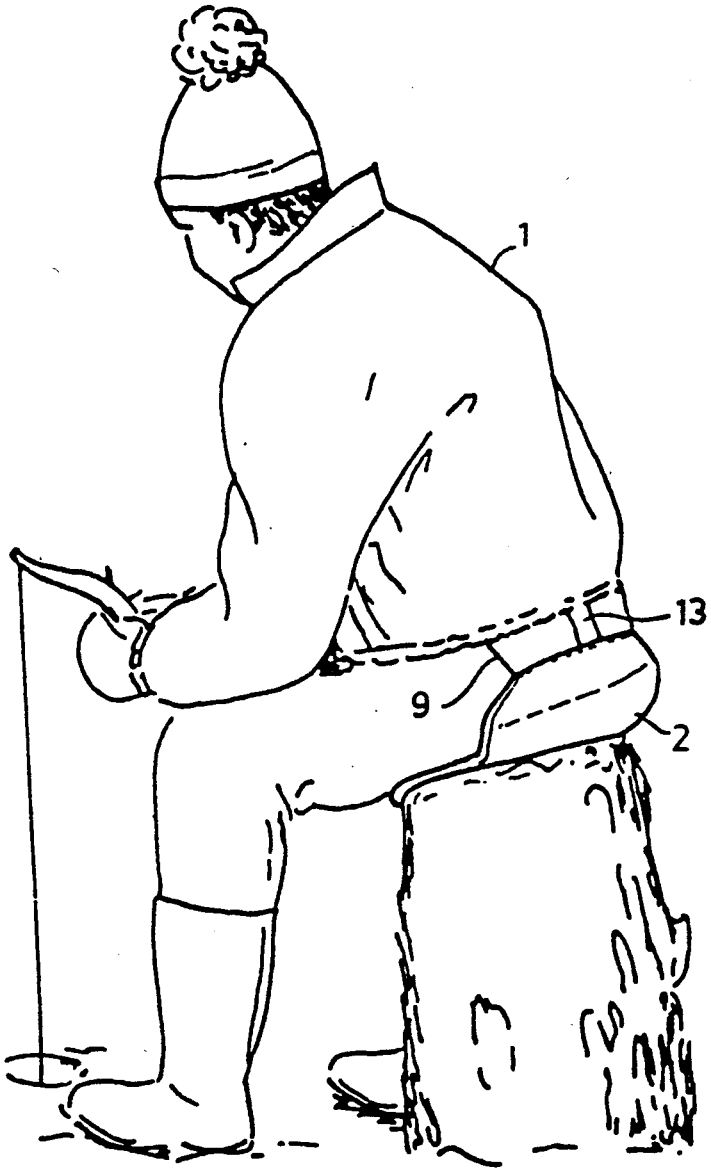
FIG. 1 is a perspective view of the inventive garment while being worn and with the protective-part occupying to its second position.

The garment of the illustrated, preferred embodiment has the form of a short coat or sportsjacket 1 which is intended for use in cold weather conditions, for instance when jigging (fishing) through ice or when skiing. In the FIG. 1 illustration, the wearer of the jacket 1 has moved the protective-part, or the seat pad 2 to its second position, i.e. beneath the buttocks of the wearer so as to protect the trousers or pants of the wearer against moisture and excessive cold in the wearer's buttock and thigh regions.

The design of the jacket or garment 1 will now be described in more detail with reference to FIG. 2. The jacket comprises an outer material layer 3, which may comprise any suitable material, although preferably a windproof and also a moisture proof material. The outer material layer 3 has attached thereto an inner material layer 4, in the present case in the form of a heat-insulating lining. Provided between the two material layers 3, 4 is a space 5 which is intended to accommodate the protective-part 2, completely between the layers. Essentially parallel with the lower edge margin 6 of the jacket, and at a location slightly above said edge margin, e.g. about 5 cm above, the lining 4 is divided over a distance which is greater than the width of the protective-part or seat pad 2, in the direction of said lower edge margin, so as to form an opening 7 which leads from the lining 4 into the space 5. The major part of the opening 7 is hidden from view in FIG. 2 by the lower parts of the protective-part 2, these lower parts extending down into the small pocket formed by the lining portions located beneath the opening 7. The protective-part 2 is prevented from falling inadvertently through the opening 7, by virtue of the fact that the lower parts of the protective-part 2 extend into said pocket. The opening 7 in the inventive garment is provided without needing to remove any of the lining 4. All that is necessary is to cut or clip the lining along a substantially straight line and then hem the resultant material edges in an appropriate manner.

Attached to each end of the upper edge 8 of the protective-part 2 is a cord 9. Each of the cords 9 is guided towards a small, preferably circular hole 11 in the collar-region 12 of the jacket, with the aid of one or more hooks or eyelets 10 fastened to the lining 4. The cords 9 are passed out through the holes 11 and can be knotted at a suitable location along respective lengths, so that the cords can only run through the holes 11 to a given extent of said lengths. Alternatively, the cords 9 can be tied together in the vicinity of the wearer's throat, to the same end. An elastic tape 13 is fastened to the protective-part 2, essentially in the centre of the upper edge 8 thereof. The opposite end of the elastic tape 13 is attached to the top of the back-part of the jacket, preferably to the surface of the lining 4 facing away from the wearer. The elastic tape 13 is intended to prevent the protective-part 2 from being located too far from the jacket, when removed through the opening 7, since otherwise the protective-part would entrain an excessive length of the cords 9. It is important that the elastic tape 13 is configured so as to ensure that the tension forces required to position the protective-part or seat-pad 2 beneath the buttocks of a wearer in accordance with FIG. 1 will not substantially influence the position of the shoulder parts of the jacket and the manner in which the shoulder parts sit on the wearer. In other words, the tape 13 shall be sufficiently elastic to ensure that the wearer is not subjected to unpleasant sensations due to stretching of the jacket or like garment around the neck, for instance, when sitting on the protective-part of seat-pad 2.

Figure 2:
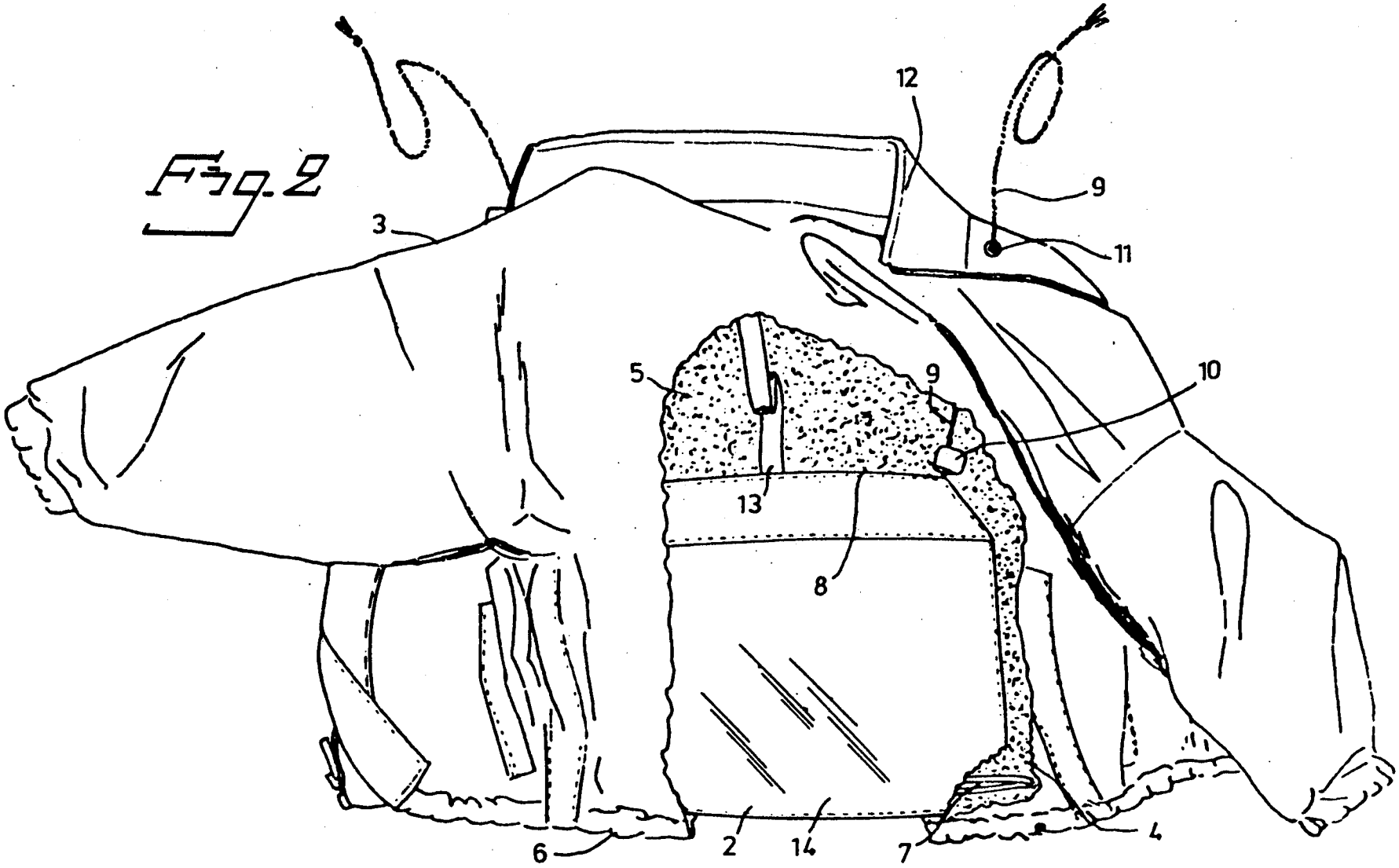
FIG. 2 illustrates in perspective the back-part of the garment shown in FIG. 1, parts of the outer material layer of the back-part of the garment being cut away so as to illustrate the protective-part in its first position and the manner in which said protective-part is attached to the garment.

The surface 14 of the protective-part 2 which faces downwards when sitting on the protective-part in the first position of said part as shown in FIG. 2 faces away from the back of the wearer. The surface 14 preferably comprises a moisture-proof material. Consequently, the surface of the protective-part which, in the position shown in FIG. 1, is intended to face towards the buttocks of the person seated upon the protective-part, will face in towards the lining 4 and the back of the wearer when the protective-part is in its second position. This surface will preferably comprise a material which is able to store the warmth absorbed from the body-heat of the person's buttocks when said protective-part is used as a seat pad in the position illustrated in FIG. 1. It is important that the opposite surface of the protective-part 2 which becomes cold and perhaps wet when using the protective-part as a seat will be turned away from the body of the wearer when said protective-part is in its second position, shown in FIG. 2. Naturally, if this cold and wet surface were to face the body of the wearer, the health of the wearer may well become impaired as a result thereof, e.g. may suffer back pains and kidney complaints caused by dampness. It will also be understood that the protective-part 2 of the inventive jacket or garment will form effective protection for the small of the back against cold, wet and wind when the protective-part 2 occupies its second position shown in FIG. 2.

The illustrated jacket 1 is used in the following manner: When the jacket is worn with the protective-part 2 in the position shown in FIG. 2, the protective-part is suspended by the cords 9, by tying knots in the cords or by tying the cords together. When the user wishes to sit on the protective-part 2, the wearer inserts one or both hands through the opening 7 and grips the lower part of the protective-part 2 and pulls the protective-part through the opening 7 to the extent permitted by the cords. The knots in the cords are then untied, so that the cords are able to run freely through the openings 11 and into the space 5. This enables the protective-part 2 to slide down in relation to the remainder of the jacket, until the elastic band 13 is fully extended. Subsequent hereto, the wearer grips the protective-part 2 and moves the protective-part to the desired position beneath his/her buttocks or the thighs of the wearer, while stretching the elastic band 13. When the wearer wishes to return the protective-part 2 to the position illustrated in FIG. 2, he or she grips said protective-part and moves the upper edge 8 of said part through the opening 7 and draws in the cords 9, so that the hole of the protective part will be drawn through the opening 7 and moved into the space 5, whereafter the cords 9 are knotted or fastened in some appropriate manner. As will be understood, the mutual sequence of movements between the various hand grips when moving the protective-part between the two positions can be varied quite considerably.

The ease with which the protective-part can be moved between the two positions is mainly due to the fact that the upper edge-margin 8 of the protective-part 2 is not fixated in relation to any part of the layers of jacket material, but is freely moveable in relation to the jacket, or like garment, as a result of its suspension from the cords 9 and the elastic band 13. This enables the protective-part 2 to be moved between its various positions by the wearer, without needing to remove the jacket or needing to roll or fold the protective-part in a manner which will influence the outer appearance of the jacket and possibly render the jacket uncomfortable to wear, because the protective-part will feel uncomfortable against the back of the wearer. The protective-part 2 can be disposed in the space 5 between the material layers 3, 4 in a manner which will prevent the protective-part from impairing the ability of the wearer to move freely within the jacket when worn. When the protective-part is disposed in the space 5 provided in the jacket 1, the jacket can be worn as a conventional jacket, apart from the positive effect provided by the protective-part in shielding the lumbar region of the wearer.

It will be understood that the invention is not restricted to the described and illustrated embodiment, and that modifications can be made within the scope of the invention as defined in the following claims.

For instance, the protective-part 2 can be suspended from solely one elastic member, or more than two elastic members, or solely one flexible member, or more than two flexible members, such as cords. Thus, the number of cords and elastic bands used may have other combination of numbers than that described.

By "collar region" used in the foregoing and in the following claims is meant the region of the garment located close to or corresponding with the location on which the collar of a collared garment is normally found. Thus, the invention can also be applied with a garment that has no collar.

Furthermore, the configuration of the protective-part and the material chosen for its manufacture can be adapted to the requirements placed on the garment by the use for which it is intended.

By outer garment is not meant that the inventive garment must necessarily constitute the outermost layer of clothing in all situations, since the inventive garment may well be worn beneath another garment, such as a raincoat or like garment. The word "outer" is meant merely to signify a garment which is primarily intended for outdoor use, although extreme indoor conditions, such as cold and drafty workshops for instance, can warrant the use of the inventive garment indoors.

The opening disposed between the two material layers may be configured in some other manner and may also be localized differently to that described, provided that the opening is located in the lower part of the back-part of the garment.

The cords 9 may also be passed through a common slide device or toggle on the front of the garment, so as to enable the length of respective cords located inwardly of the openings 11 to be adjusted, by displacing the cords relative to said device and securing said cords in desired relative positions.

I claim:

1. An outer garment for a person which comprises an outer shell having an upper collar region, a lower edge, and at least two holes in said collar region, an inner lining comprising one or more layers of material and having a lower edge and inner and outer surfaces, an insulating pad having upper and lower edges, two elongated members and a flexible vertical strap, the elongated members and the strap each having upper end lower ends, and a space intermediate the inner lining and the outer shell, wherein the lower end of the vertical strap and the lower ends of the elongated members are attached to the upper edge of the insulating pad, the upper ends of the elongated members extend through said holes in said collar region, the upper end of the vertical strap is attached to outer surface of the inner lining, the space extends through an opening between the lower edge of the outer shell and the lower edge of the inner lining and wherein the pad is held in a first position within said space by fastening the upper ends of the elongated members at said collar region holes, and the insulating pad is held in a second position substantially below the lower edge of the outer shell by the vertical strap to function as a seat upon release of said elongated members.

2. A garment according to claim 1, characterized in that the insulating pad is thin and sheet-like, and has at least dimensions which are commensurate to the size of a person's buttocks, such as to provide a seating surface; and in that said insulating pad is soft and flexible and when located in said space is able to lie flat and conform to the shape of the wearer's body, so as not to influence the outer appearance or cut of the garment.

3. A garment according to claim 1, characterized in that the garment is a sportsjacket; in that the material layers comprise an outer layer and a lining disposed inwardly of said outer layer; and in that the opening leading to the space between the layers is disposed above a bottom edge of a back-part of the jacket and is formed by a slit in the lining extending substantially parallel with said bottom edge.

4. A garment according to claim 3, characterized in that part of the lining protrudes up along a lower edge of the back-part of the jacket, from a lower point at which the lining is joined to the outer layer, and up to said opening and forms together with said outer layer a pocket or like container; and in that when the insulating pad occupies its first position, said pocket is intended to receive the bottom edge-part of the insulating pad, so as to prevent the insulating pad from falling or sliding from the space should the elongated members be unintentionally lengthed while said insulating pad is located in its first position.

5. A garment according to claim 1, wherein the insulating pad when located in said first position will form a shield against cold and/or wind across the lumbar region of the person wearing the garment.

6. A garment according to claim 1, characterized in that the elongated members include cords; and in that when the insulating pad occupies its first position, the cords are intended to be tied together or knotted individually externally of respective holes located in the collar region of the garment with knots of larger cross-section than said holes, such as to prevent the insulating pad from falling through the opening leading to said space.

7. A garment according to claim 1, characterized by guide devices which are attached to the surface of the inner material layer facing the outer material layer and which, in the first position of the insulating pad are operative to guide the elongated members towards said holes provided in the collar region of the garment.

8. A garment according to claim 1, characterized in that the flexible vertical strap is made of elastic.

* * * * *